US006619005B1

(12) United States Patent
Chen

(10) Patent No.: US 6,619,005 B1
(45) Date of Patent: Sep. 16, 2003

(54) MOLDED DOORS WITH LARGE GLASS INSERT

(76) Inventor: Kuei Yung Wang Chen, 201 Tung Hwa Road, Taipei (TW)

( * ) Notice: Subject to any disclaimer, the term of this patent is extended or adjusted under 35 U.S.C. 154(b) by 40 days.

(21) Appl. No.: 10/123,854

(22) Filed: Apr. 16, 2002

(51) Int. Cl.[7] ..... F06B 3/68

(52) U.S. Cl. ..... 52/455; 52/784.1; 52/784.15; 52/784.16; 52/206; 52/207; 52/800.1; 49/59; 49/502

(58) Field of Search ..... 52/455, 784.1, 52/800.1, 206, 207, 784.15, 784.16; 49/501, 503

(56) References Cited

U.S. PATENT DOCUMENTS

| | | | | | |
|---|---|---|---|---|---|
| 956,556 | A | * | 5/1910 | Wege | 52/800.17 |
| 2,905,983 | A | * | 9/1959 | Ritz | 52/209 |
| 3,885,351 | A | * | 5/1975 | Imperial et al. | 49/501 |
| 4,167,088 | A | * | 9/1979 | Governale | 52/207 |
| 4,374,693 | A | * | 2/1983 | Pitt | 156/267 |
| 4,397,117 | A | * | 8/1983 | Shipp | 49/501 |
| 4,496,201 | A | * | 1/1985 | Allgeyer | 312/296 |
| 4,546,585 | A | * | 10/1985 | Governale | 52/309.11 |
| 4,635,421 | A | * | 1/1987 | Newberg | 52/309.11 |
| 4,720,951 | A | * | 1/1988 | Thorn et al. | 52/208 |
| 4,752,517 | A | * | 6/1988 | Beitel | 428/122 |
| 4,850,168 | A | * | 7/1989 | Thorn | 52/207 |
| 4,897,975 | A | * | 2/1990 | Artwick et al. | 52/208 |
| 4,901,493 | A | * | 2/1990 | Thorn | 52/309.9 |
| 4,920,718 | A | * | 5/1990 | Artwick et al. | 52/476 |
| 4,934,040 | A | * | 6/1990 | Turchan | 29/566 |
| 4,965,030 | A | * | 10/1990 | Thorn | 264/46.5 |
| 5,022,206 | A | * | 6/1991 | Schield et al. | 52/455 |
| 5,074,087 | A | * | 12/1991 | Green | 52/309.9 |
| 5,088,255 | A | * | 2/1992 | Emanuel | 52/395 |
| 5,105,597 | A | * | 4/1992 | Wilkening | 52/455 |
| 5,161,346 | A | * | 11/1992 | Olson et al. | 52/746.1 |
| 5,239,799 | A | * | 8/1993 | Bies et al. | 52/309.11 |
| 5,325,648 | A | * | 7/1994 | Menard | 52/456 |
| 5,353,579 | A | * | 10/1994 | Wolff | 56/15.2 |
| 5,577,355 | A | * | 11/1996 | Leonelli | 52/204.62 |
| 5,577,363 | A | * | 11/1996 | Tate et al. | 52/784.15 |
| 5,634,508 | A | * | 6/1997 | Herbst | 160/371 |
| 5,644,870 | A | * | 7/1997 | Chen | 49/501 |
| 5,644,874 | A | * | 7/1997 | McKann | 52/202 |
| 5,644,881 | A | * | 7/1997 | Neilly | 52/455 |
| 5,775,041 | A | * | 7/1998 | Tull et al. | 52/455 |
| 5,829,218 | A | * | 11/1998 | Murray et al. | 52/455 |
| 5,887,398 | A | * | 3/1999 | Chen | 52/309.9 |
| 5,941,032 | A | * | 8/1999 | Lydon, Jr. | 52/204.1 |
| 6,068,802 | A | * | 5/2000 | Berghorn et al. | 264/46.5 |
| 6,151,849 | A | * | 11/2000 | Twigg et al. | 52/208 |
| 6,161,363 | A | * | 12/2000 | Herbst | 52/784.15 |
| 6,311,454 | B1 | * | 11/2001 | Kempel | 52/784.15 |
| 6,389,769 | B1 | * | 5/2002 | McKinney et al. | 52/309.9 |
| 6,434,898 | B1 | * | 8/2002 | Ward et al. | 52/204.62 |

* cited by examiner

*Primary Examiner*—Carl D. Friedman
*Assistant Examiner*—Christy Green
(74) *Attorney, Agent, or Firm*—Joseph L. Strabala

(57) ABSTRACT

An improved molded door having provisions for glass insert comprising at least 50% of said door's exterior surface includes a quadrilateral frame formed of a top rail, a bottom rail, a right stile and a left stile joined together, two sheets of molded door skins, each skin having a large central opening with an inwardly directed flange extending normal to its planer surface and around its respective opening, which flanges interlock when assembled on frame and form secondary frame for receiving a glass insert, means operable to join the skins to the quadrilateral frame, means operable to join the integral flanges of the skins in an interlocked relationship around their respective openings thereby forming an interlocked secondary frame for receiving a glass insert, a secondary left stile located between the joined flanges and the left stile with this stile joined to the skins and a secondary right stile located between the joined flanges and the right stile with this stile joined to said skins whereby the door supports said insert without twisting and bending when in service.

12 Claims, 13 Drawing Sheets

MOLDED DOORS WITH LARGE GLASS INSERT

BACKGROUND OF THE INVENTION

1. Field of the Invention

A common place substitution for the traditional wooden doors in residential and commercial buildings are synthetic doors. One type of synthetic doors is formed with resin sheets reinforced with fiber glass (in the art referred to as skins) attached to opposite sides of a rectangular frame with resulting cavity between the skins filled with a plastic foam. Doors so constructed can include wood graining on their outer surfaces of the skins, and also raised paneling formed (molded) in the skins, which gives these doors the appearance of natural wood fabricated products.

Molded skins for making such doors of the type described are disclosed in U.S. Pat. No. 3,950,894 issued to DiMaio and in U.S. Pat. No. 4,550,540 issued to Thorn. These skins are typically formed using mixtures, having by weight 12% to 15% polyester resin, 5% to 15% polystyrene, 40% to 50% calcium carbonate and 15% to 25% chopped fiberglass. Such mixtures are layered in a compression molding machine and subjected to pressures from 600 to 1,500 psi for a cure cycle from 60 to 200 seconds to form rigid skins. The mixture described is one of those known 'sheet molding compounds' [SMCs]. A general description of the sheet molding process is found in an article entitled, "Compression Molding" by N. D. Simons in *Modern Plastics Encyclopedia*, Vol. 54 No. 10A (1977–78).

Skins formed from SMC processes for doors can have thicknesses of from about 0.13 mm (0.05 inches) to about 52 mm (0.20 inches), depending on the door application in which they are used.

As previously noted such skins are affixed to opposite sides of a rectangular frame and the core (cavity) enclosed by the frame and skins is filled with a plastic foam to complete the door. A rigid urethane foam having a density of 0.8 pounds per cubic foot to 3.5 pounds per cubic foot is suitable for the core of such doors.

Prior art conventional molded doors of the type described can be generally classified, according to height, into two types: one is the standard molded door with a height of about 200 cm (or about 6 feet 8 inches), and the custom molded door with a height of about 250 cm (or about 8 feet), both doors are made in conventional widths, with the width of 94 cm (or about 3 feet) being the most common. Special molded doors may be 10 or 12 feet high.

In the past these prior art doors had glass inserts [lights] that covered less than 30% of the door's exterior surface, see e.g., U.S. Pat. No. 4,720,951 issued to Thorn. Currently the market place demands doors with large glass inserts or lights which can comprise more than 60% of the doors exterior surface. Due to building codes these large lights must be double glazed (double pane) and in some cases made of safety glass. As a result the insert may weigh in the range of 16.5 to 37.5 kilograms (44 to 100 lbs) and the skins in such doors are not capable of satisfactorily supporting this weight without innovations in the door structure for supporting the insert. This is particularly true in the taller, custom molded door structures and is especially true in the special molded doors described above.

This invention relates to improved molded doors composed of skins disposed on a door frame of stiles and rails which have a large central glass insert, by providing interior reinforcing means disposed adjacent to an insert frame structure formed in and joining the opposing skins, which cooperatively strengthen the door and enables a transfer of the weight of the insert to the door components without deformation or bending of the perimeter frame door due to the weight of the glass insert. Moreover the invention prevents flexing of the door components which otherwise might dislodge the large glass insert.

Thus it is an object to provide a molded door which is constructed in a manner to support large glass inserts while still taking advantage of the features available when using the SMC skins, such as wood graining, resistance to insect infestation, etc.

Another object of the invention is to arrange reinforcing (anti-bending means) in the interior of a custom molded door with large glass insert to strengthen it without creating an interference with the subsequent installation of the door hardware, e.g. latching mechanisms and hinges.

A further object of the invention is to incorporate internal structures in molded door with a large glass insert, particularly in the custom molded doors, to avoid deformation, flexing, twisting and the like resulting from the weight of the glass insert when the door is placed in service.

The further feature of the invention is to install reinforced anti-bending means inside a custom molded door with glass insert and against each internal wall of glass frame used for installing glass insert of molded door skin with opening to directly support the full weight of glass insert and strengthen the structural strength using anti-deformation and anti-bending elements.

SUMMARY OF THE INVENTION

An improved molded door having provisions for glass insert comprising at least 50% of said door's exterior surface includes a quadrilateral frame formed of a top rail, a bottom rail, a right stile and a left stile joined together, two sheets of molded door skins, each skin having a large central opening with an inwardly directed flange extending normal to its planer surface and around its respective opening, which flanges interlock when assembled on frame and form secondary frame for receiving a glass insert, means operable to join the skins to the quadrilateral frame, means operable to join the integral flanges of the skins in an interlocked relationship around their respective openings thereby forming an interlocked secondary frame for receiving a glass insert, a secondary left stile located between the joined flanges and the left stile with this stile joined to the skins and a secondary right stile located between the joined flanges and the right stile with this stile joined to said skins.

BRIEF DESCRIPTION OF THE DRAWING FIGURES

This invention will be better understood by reference to this specification in conjunctions with the accompanying drawings wherein.

Figure 9:
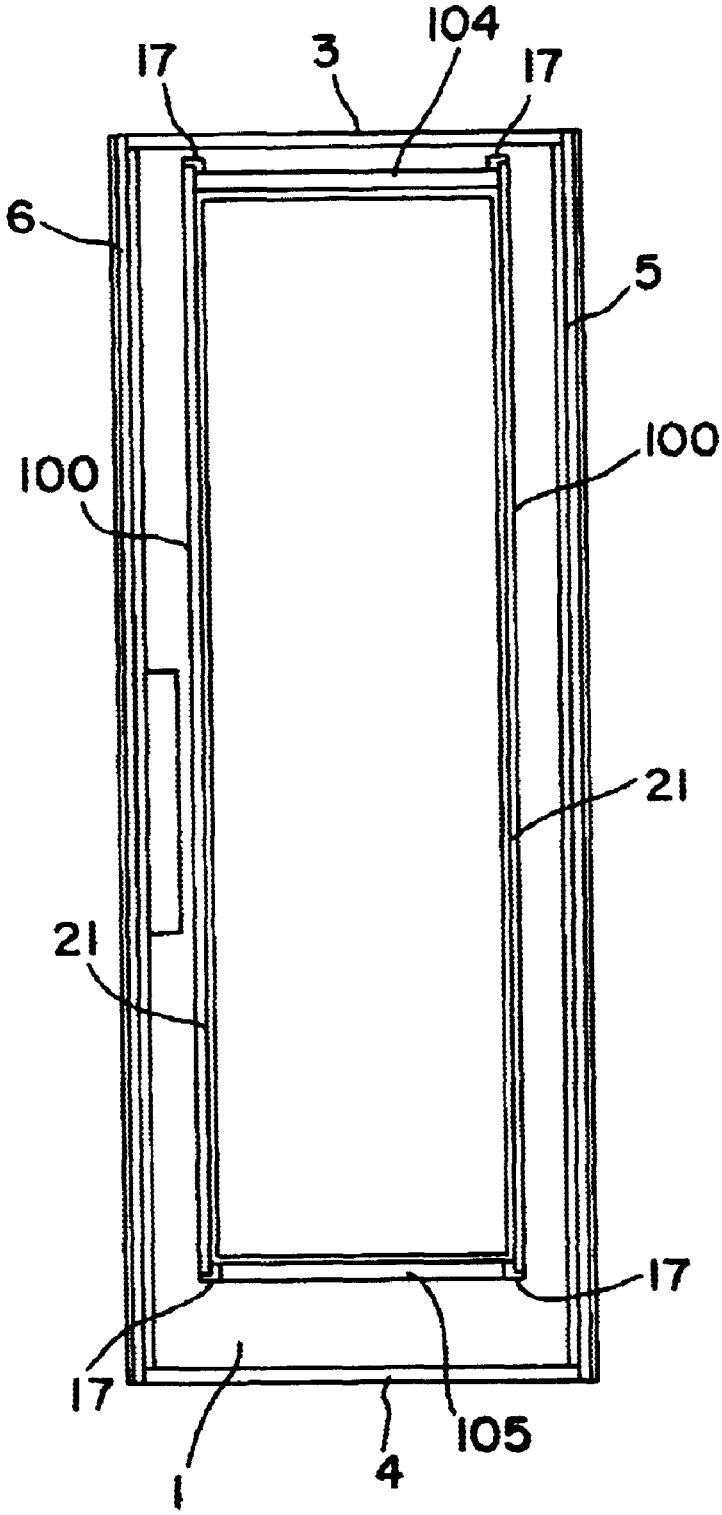
FIG. 9 is a plan of the improved molded door with one of the skins (top skin in the drawing) removed to show the internal structure of this embodiment of the invention with the secondary stiles abutted against the internal faces of the flanges forming the frame for the glass insert.
Figure 15:
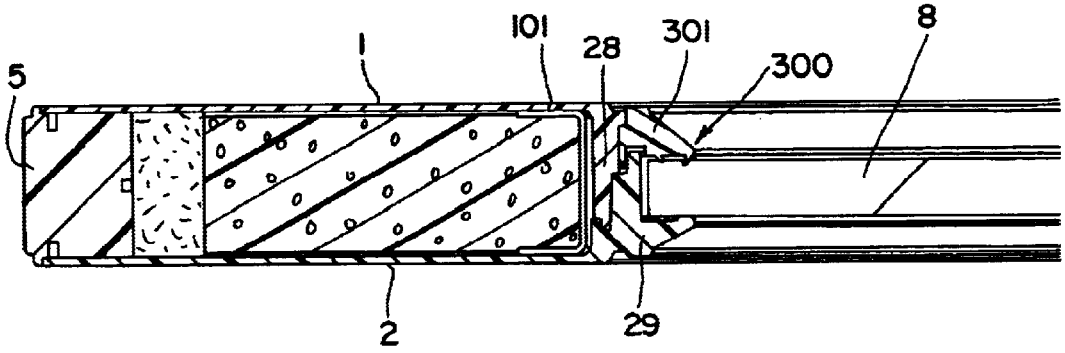
Figure 16:
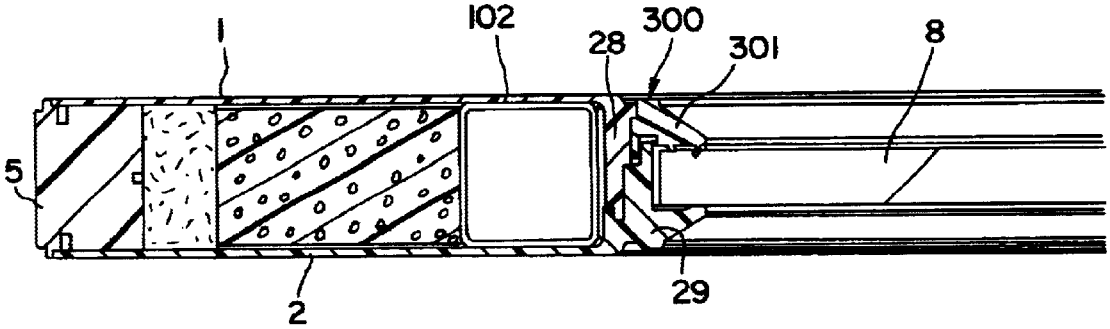

FIG. 15 is a cross-sectional of the embodiment shown in FIG. 9 illustrating the location of the channel or U-shaped reinforcing element abutting against the inside face of the interlocked frame for the glass insert; and FIG. 16 is a cross-section of an the embodiment employing hollow reinforcing elements used as secondary stiles and abutting the inside face of the interlocked frame for the glass insert.

DETAILED DESCRIPTION OF PREFERRED EMBODIMENTS

Applicant of the present invention engaged in serious research and development to obtain a suitable design for custom molded doors with large glass inserts. It was determined that the location of the reinforcement (anti-bending means) installed in the interior of the door for strengthening must not interfere with installation of the door hardware when door is placed in service. Accordingly, applicant developed several embodiments of the invention employing different reinforced structures with this fact in mind. All embodiments of the invention disclosed will prevent deformation and bending of the improved doors from the weight of the large glass insert to some degree, but the design where the reinforcing is placed against the integral secondary frame for the glass insert (see e.g., FIGS. 15 and 16 for details) is the most preferred embodiment as it provides improved stabilization of the door structure and better distribution of the weight of the insert to the skins and supporting frame.

Figure 1:
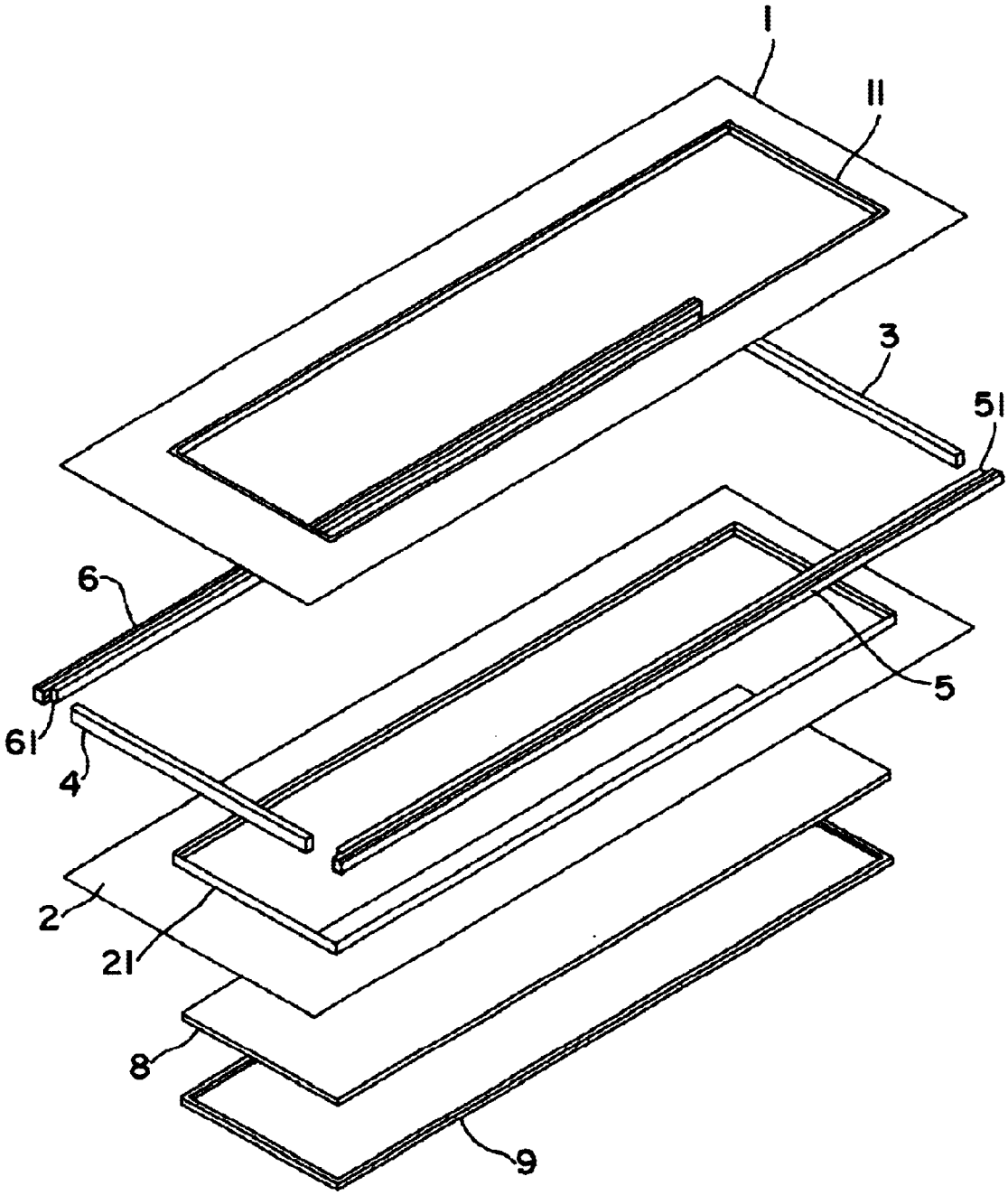
FIG. 1 is an exploded view of a conventional molded door with a large glass insert or light.

Referring to FIG. 1, the exploded structure of a prior art door with glass insert is shown. It has two molded door skins 1, 2 each having a large aperture with an extending flange 11, 21 for receiving a glass insert 8. The skins are attached to a top rail 3, a bottom rail 4, a right stile 5, a left stile 6 after these components are joined to form a rectangular frame. To provide increased strength to the frame a reinforcing element 51 is joined to right stile, a second reinforcing element 61 is joined the left stile. A glazing rim 9 is employed to hold the glass insert in the aperture.

As indicated above the molded door skins 1 and 2 are formed sheet molding compounds and will have a thickness of about 1 to 4 mm. These molded doors are joined, typically with adhesives, to a quadrilateral frame.

The surface of said molded door skin with opening can be a smooth surface without graining or with graining wherein the depth the graining of about 0.05~0.2 mm. Typically the underside or the opposite side of said molded door skins is formed with a rough surface to increase the surface area for the adhesive; this results in stronger bonds between the skins, foam and the frame. The assembled structure mentioned above is the basic structure used for both standard and custom molded doors with glass inserts.

Figure 2:
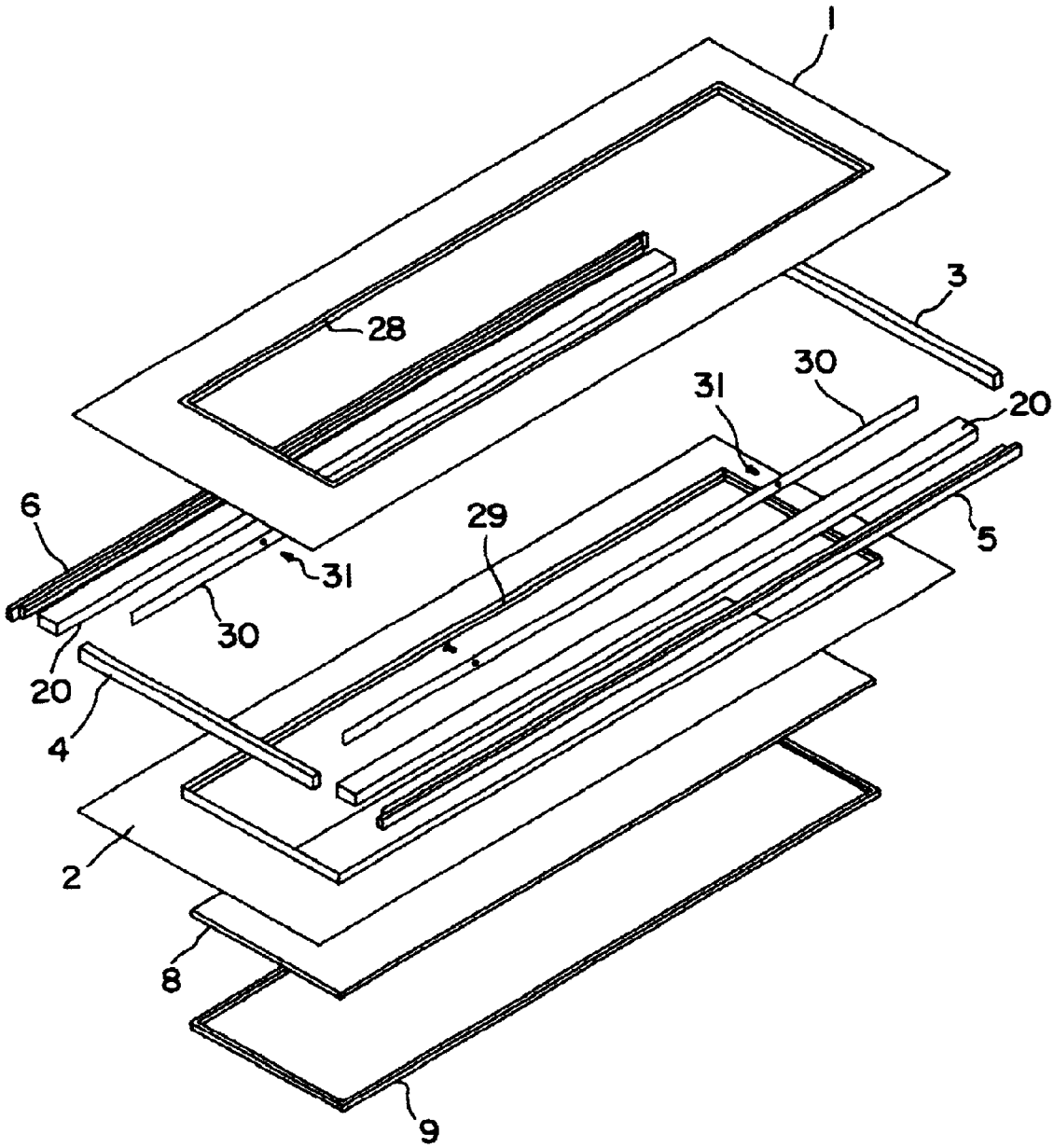
FIG. 2 is an exploded view of one embodiment of the invention.
Figure 3:
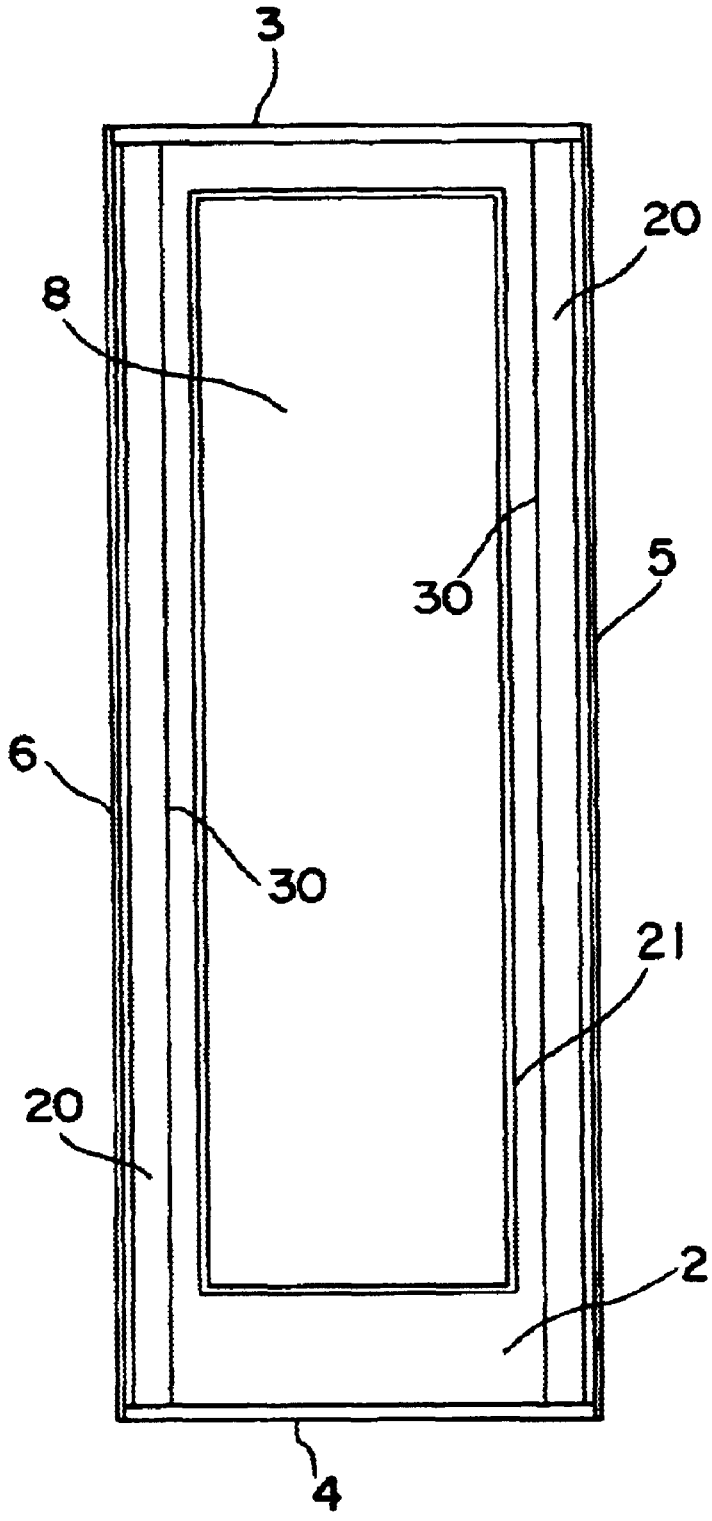
FIG. 3 is plan of the improved molded door with one of the skins (top skin in the drawing) removed to show the internal structure of the embodiment shown in FIG. 2.

Referring to FIG. 2 and FIG. 3, a preferred embodiment of the invention two broad-faced reinforcing elements 20, formed of wood or foamed plastics or other materials and generally having a rectangular cross-section, are placed inside a custom molded door with a glass insert where flexing, deformation, and twisting are prevalent. These elements ate placed between the stiles 5, 6 and the interlocking secondary frame 300 for the glass insert (see FIG. 8 for this secondary frame detail) formed by special flanges 28 and 29 on skins 1 and 2 and are connected to these skins, with adhesives or the like.

The broad-faced reinforcing elements 20 may be positioned and be wide enough to provide anchoring structures for door hardware, such as latches, hinges and the like. For example if these elements are at least 10 mm (about 4 inches) in width, in combination with the interlocking secondary frame 300 for the insert, will provide stabilizing in most door structures of this type, including custom doors (those with a height of 250 mm (about 8 feet)).

After assembling the door structure shown in FIG. 2, the interior voids (cavities) are filled with polyurethane foam or PS, or the like. Thereafter the glass insert 8 can be inserted into the secondary frame 300 and then locked into the frame with a rim or keeper 301, which relationship between the frame and insert is best illustrated in FIG. 8.

Figure 4:
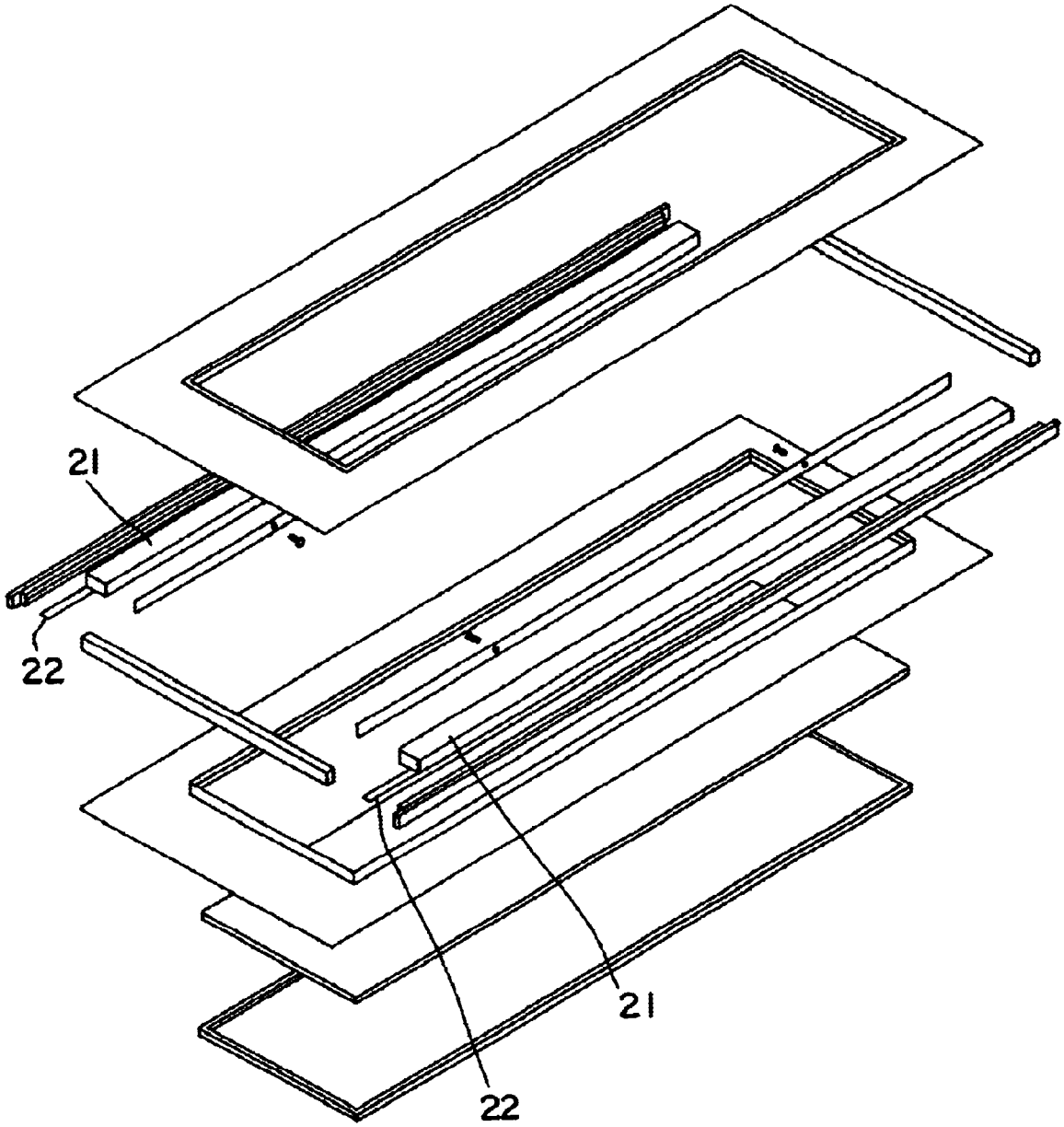
FIG. 4 is an exploded view of an alternative embodiment of the invention to that shown in FIG. 2.
Figure 5:
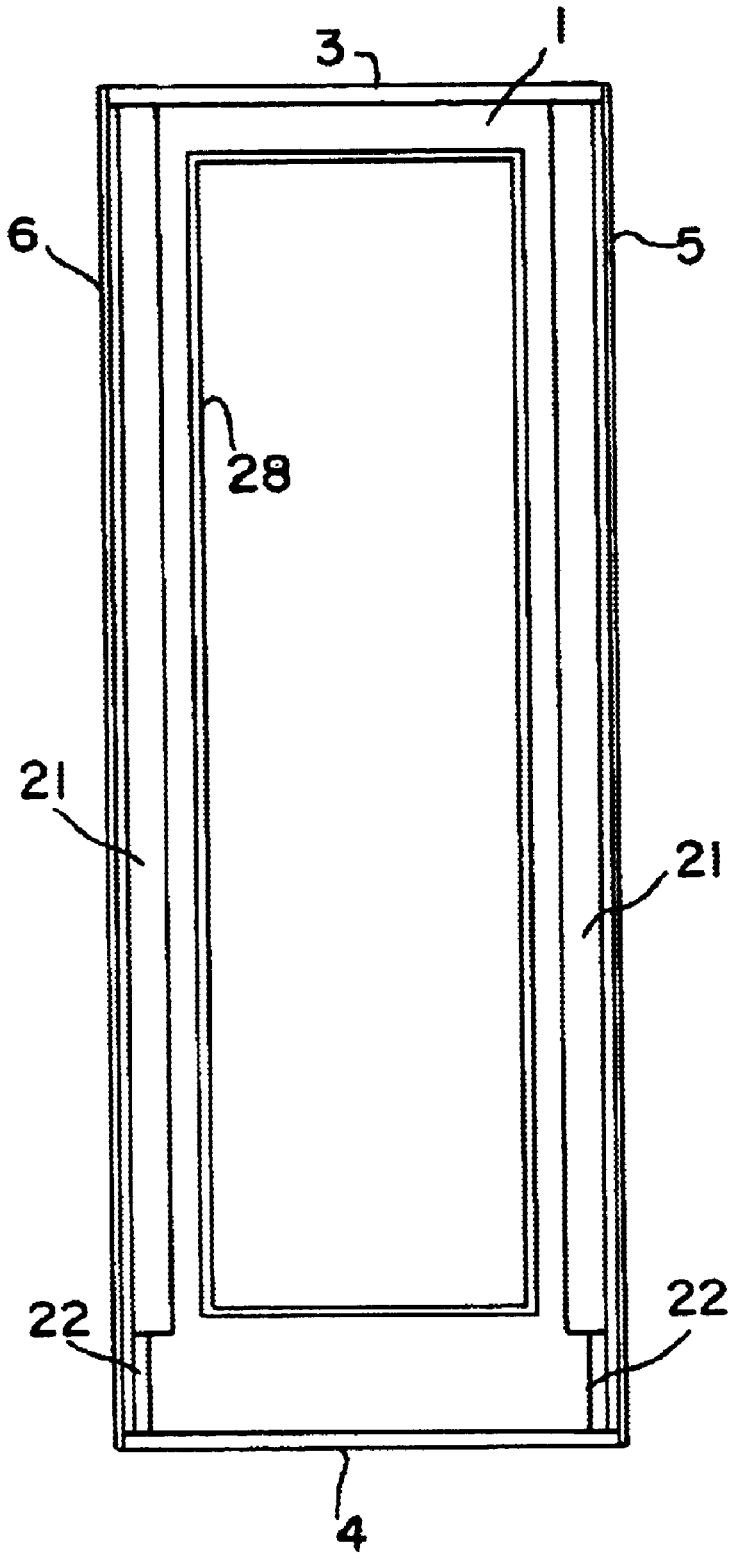
FIG. 5 is plan of the improved molded door with one of the skins (top skin in the drawing) removed to show the internal structure of the embodiment shown in FIG. 4.

An further enhanced version of the novel door shown in FIG. 2 and FIG. 3 is illustrated in FIGS. 4 and 5. In this embodiment a long reinforcing metal plate 30 is joined to each of the inside faces of said two broad-faced reinforcing elements 20 with screws, such as plastic screws, to increase the stiffness of these elements. Also as can be seen in FIG. 4 and FIG. 5, for sake of reducing costs and without affecting the structural strength, shorter broad-faced reinforcing elements 21 are employed, with a length shorter than said broad-faced reinforcing elements shown in FIG. 2 or FIG. 3, can be used with spacer 22 located at the bottom end of these elements to properly position them in the interior of the door when it is assembled.

Figure 6:
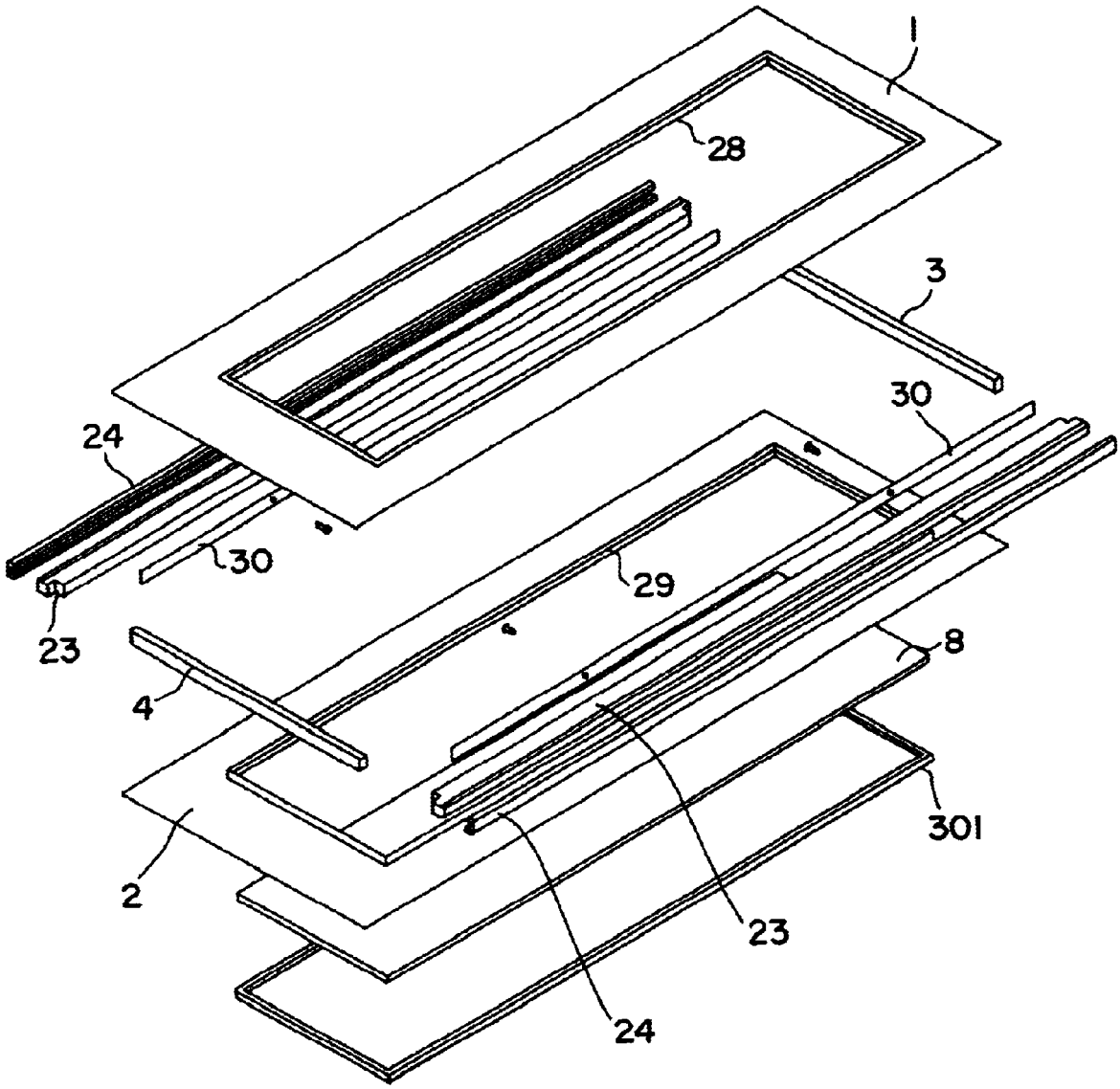
FIG. 6 is an exploded view of another embodiment of the invention showing two broad-faced reinforcing elements used to form the secondary left stile and secondary right stile and a metal extrusion forming the left stile and a metal extrusion forming the right stile.
Figure 7:
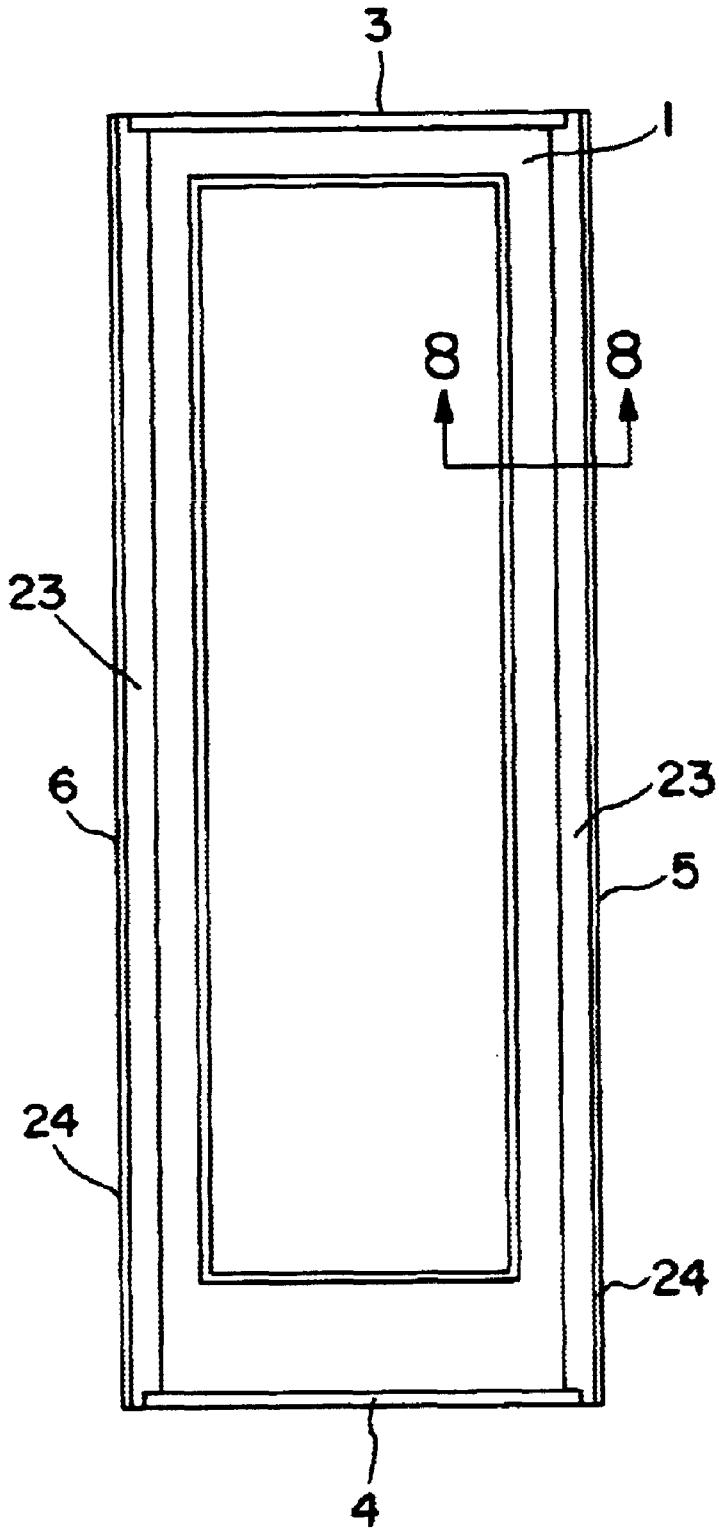
FIG. 7 is a plan of the improved molded door with one of the skins (top skin in the drawing) removed to show the internal structure of the embodiment shown in FIG. 6.

Referring to FIG. 6 and FIG. 7, an embodiment of the invention two broad-faced reinforcing elements 23 forming the secondary stiles are married with a metal 241 left stile and metal right stile 241 of a custom molded door with glass insert. Referring to FIG. 8, the metal left stile illustrated as u-shaped member which has has inwardly directed ears 241(*a*) that are used to join it to its broad-faced elements. As can be seen in this figure, grooves 231 are is formed at the outboard face of each broad-faced reinforcing elements 23 by cutting a predetermined depth from both side faces near the end of these elements. The outboard face of these elements are also milled so that the channel 241*b* in the metal stiles will slide onto these secondary stiles in an interlocking relationship. As the metal stiles are longer than their respective secondary stiles, the ends of rails at the top and bottom of the door can be milled to be received in the channel in stiles to lock the metal stiles with these rails. For more reinforcing a long metal plate 30 is connected to each secondary stile as shown in FIG. 8. and as indicated it is screwed to the inboard face of each stile.

Figure 8:
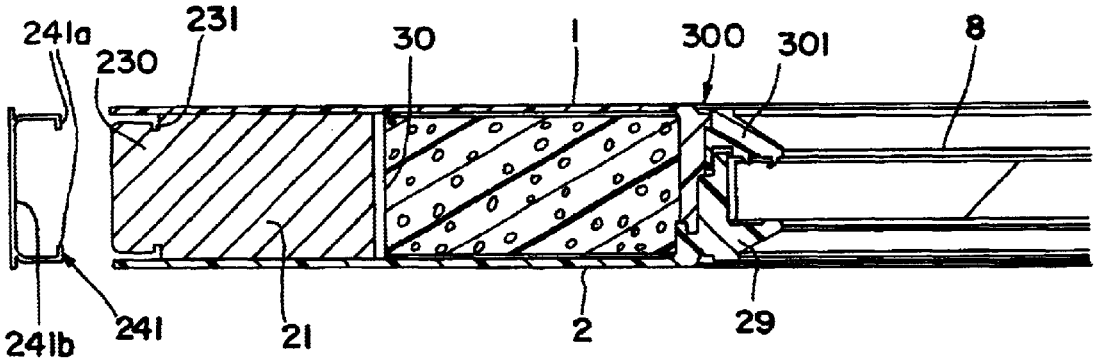
FIG. 8 is a cross-section taken along the line 7—7 of the embodiment shown in FIG. 7 illustrating how the skins are joined with one another to form the interlocked frame for receiving the glass insert.

Referring to FIG. 9, the preferred embodiment of the invention is to install the secondary stiles (reinforcing and anti-bending means) 100 against each internal face of vertical wall of the secondary frame 300 formed with the molded door skins 1 and 2 (see secondary frame detail in FIGS. 8 and 15. Here the secondary stiles abut against the secondary frame and preferably ate attached to it by adhesives. As can be appreciated the weight of the glass insert in the secondary frame is concentrated at the bottom of this secondary frame the full weight of said glass insert 8 is located here and must be distributed to a significant area of skins of the door to prevent the skins from bulking from this weight by abutting the secondary stiles against the vertical inside faces of the secondary frame and gluing these stiles to the skins the weight is widely distributed and supported where it is concentrated.

Figure 10:
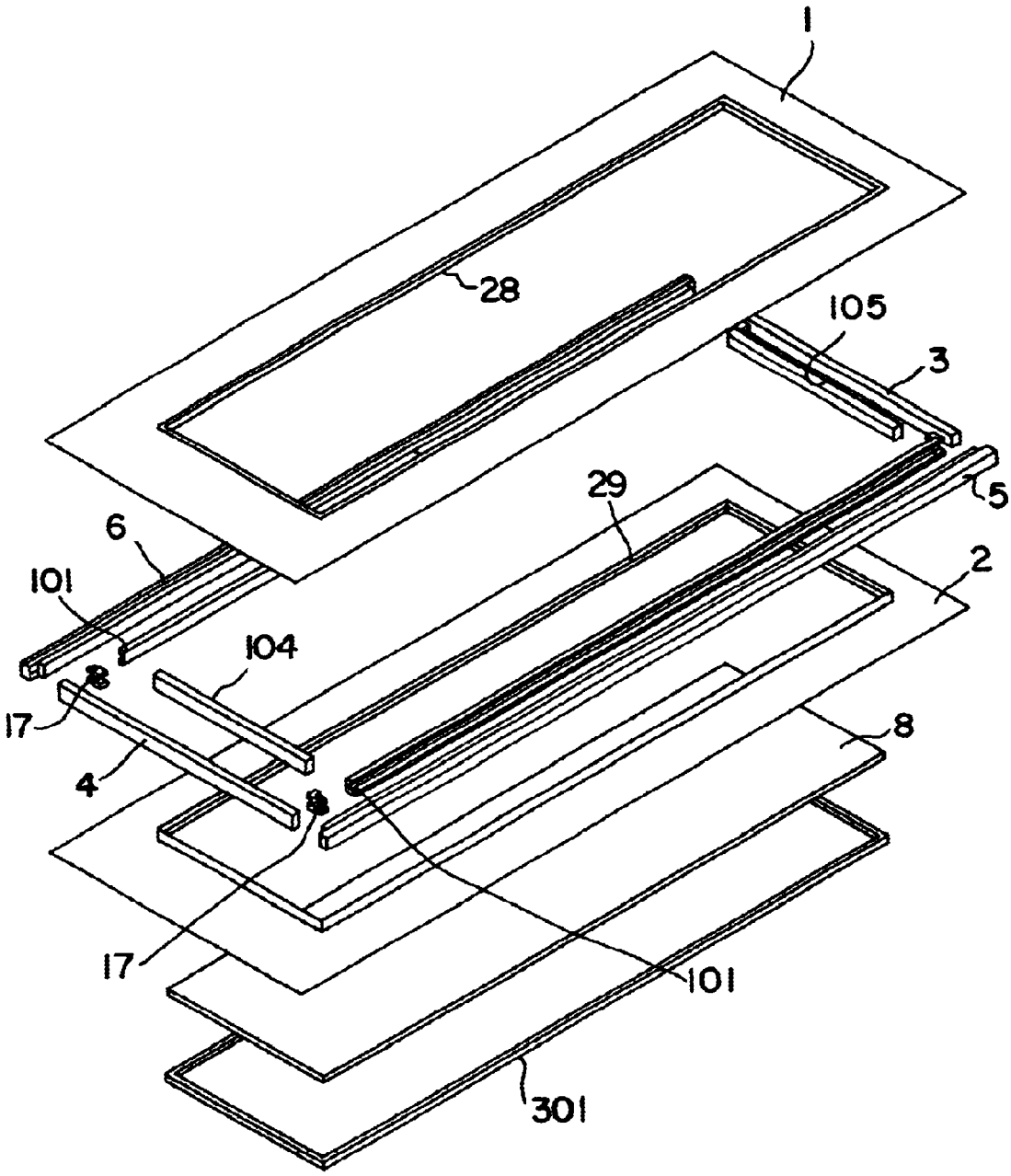
FIG. 10 is an exploded view of the embodiment of the invention shown in FIG. 9 better illustrating the channel or U-shaped reinforcing elements employed as the secondary stiles and using I-shaped connecting fittings for joining top and bottom ends of these secondary stiles.
Figure 11:
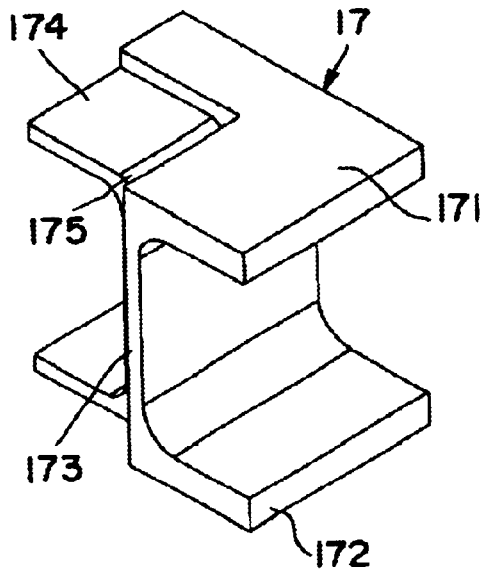
FIG. 11 is a perspective of I-shaped connecting fittings shown in FIG. 10.
Figure 12:
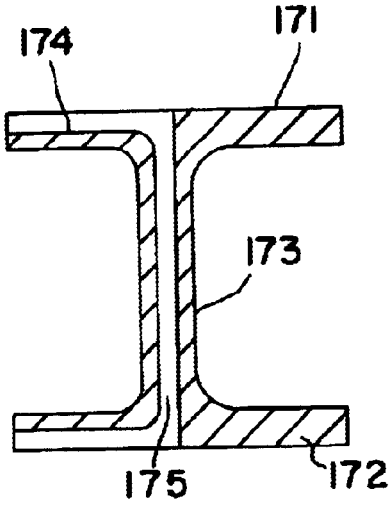
FIG. 12 is a cross-section of I-shaped fixing fittings shown in FIG. 11.

In FIG. 10, a preferred constructions of the secondary stiles for the embodiment of FIG. 9 is illustrated. U-shaped metal reinforcing elements 101 are used to form the secondary stiles. This same material is used to form a top secondary rail 104 and the bottom secondary rail 105. Four I-shaped fittings 17 are used to connect the ends of these metal stiles and rails, the details of which can be seen in FIGS. 11, 12 and 13. In this preferred embodiment the metal secondary stiles and rails form an integral frame about the secondary frame 300 formed by the flanges 28 and 29 of the skins 1 and 2 with fittings 17 joining them. During assembly these secondary metal stiles and rails are bonded to the secondary frame and to the skins thereby creating a structure for distributing the weight of the glass insert 8 to the components of the door. While metal is preferred the U-shaped reinforcing materials 101, 104 and 105 can be metal, extrusion material, wood, or PVC extruded material.

When using metal for the secondary stiles and rails their ends must be mechanically connected. Fittings 17 shown in FIGS. 11 and 12, serve this purpose and generally have an "I" shape with a middle rib plate 173 connected to the middle of the top plate 171 and the middle of the bottom plate 172. The top and bottom plates are parallel and the middle connection results in two U-shaped openings. In addition, a groove 175 which passes through the top plate 171 and the bottom plate 172 separates a portion of one of the U-shaped openings as can be seen in the figures mentioned above. At one side of the u-shaped openings the top and bottom plates are milled away to form recessed areas 174. Using the metal secondary stiles the elasticity modulus is greatly improved over the use of wood elements as secondary stiles. A wooden secondary stile 100.4 mm in width and 40.4 mm in thickness has an elasticity value "E" of 1500 kg/mm$^2$. In comparison an iron U shaped channel of a thickness of 2 mm and 40 mm in width with flanges of 22 mm has an "E" of 21000 kg/mm$^2$. The improved elasticity modules in these doors achieved by using applicant's metal reinforcing versed wood can be calculated as follows: Improvement=21000/1500=14 since the "I" value is nearly the same for these materials.

Figure 13:
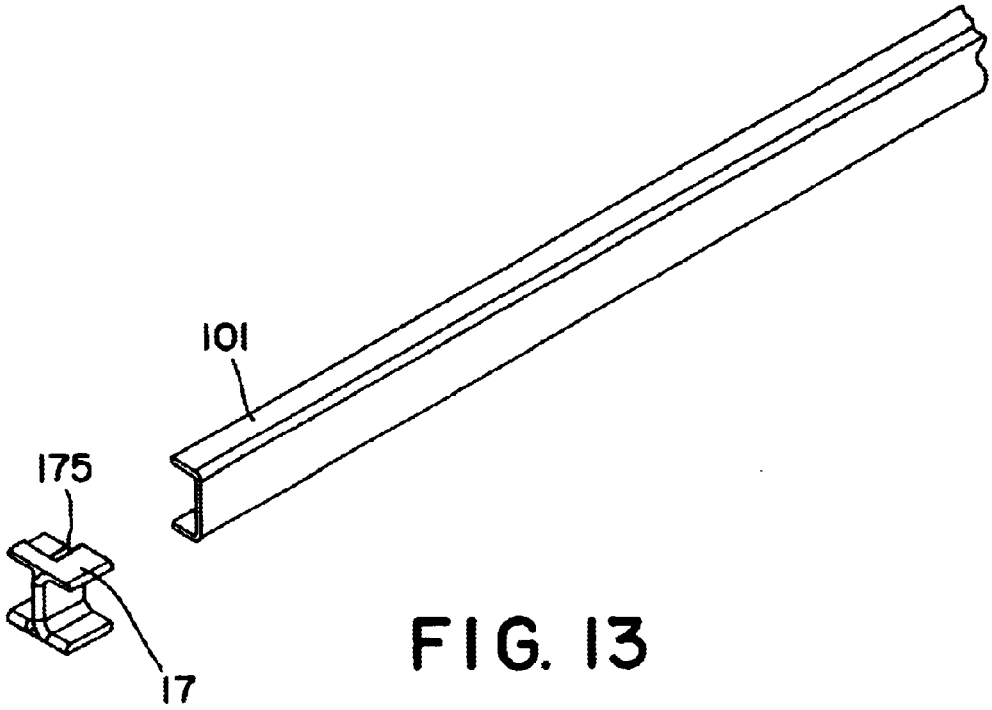
FIG. 13 is a perspective illustrating how the I-shaped fittings are used to join the channel or U-shaped reinforcing elements forming the secondary stiles shown in FIG. 9.

Fitting 17 so constructed can be use to join the secondary metal stiles and rails shown in FIG. 9 as illustrated in FIG. 13. It can be seen that the end of secondary stile 101 is received in the groove 175 and the recessed surfaces 174 of the fitting slide into the channel of the U-shaped stile.

Figure 14:
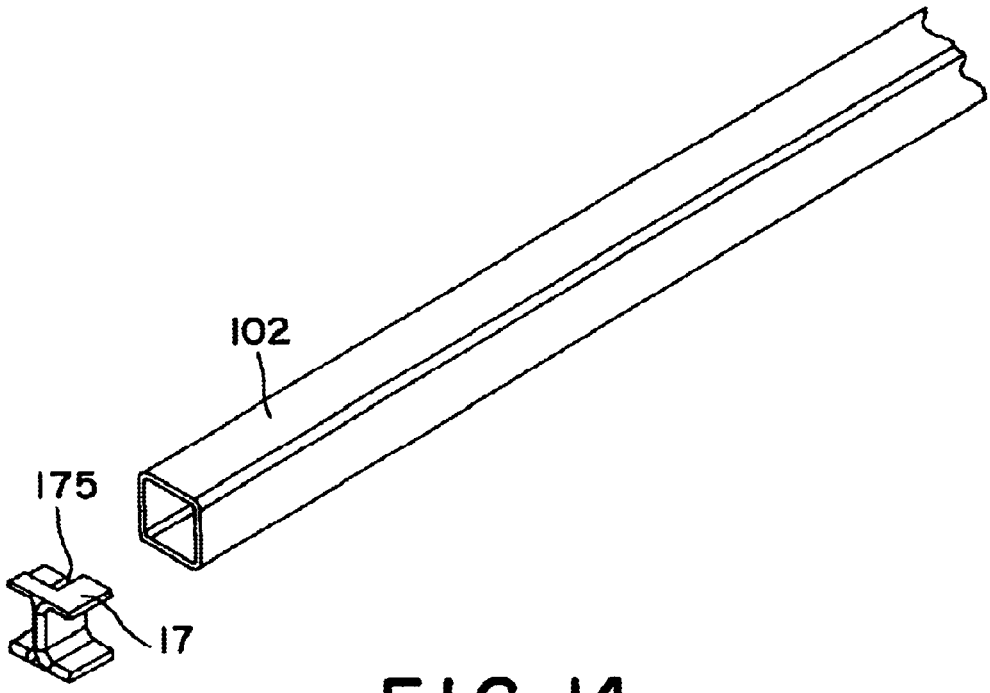
FIG. 14 is a perspective illustrating how I-shaped fittings shown in FIG. 13 can be used to join tubular reinforcing elements used as secondary stiles.

In FIGS. 14 and 16 two hollow rectangular reinforcing elements or secondary stiles 102 are used to replace said two U-shaped reinforcing elements of secondary stiles 101 which are shown in FIGS. 8 and 15. When this substitution is made for the secondary stiles and secondary rails, the same fitting 17 can be used to join their ends to result in an integral frame encasing the secondary frame 300. The material of said hollow rectangular reinforcing elements shown in these figures can be metal, wood, or PVC extruded material.

Assembling this kind of custom molded door with glass insert of the invention the right stile 5 and the left stile 6 are joined with the top rail 3 the bottom rail 4 to form the quadrilateral frame. The previously molded skin 1 is laid flat and this frame placed on the skin is glued to it, see lay out in FIG. 10. Once this frame is in place the secondary stiles 102 can be placed against the inside surface of flange 28 of skin 1 and then the secondary top rail 104 is joined to the tops of the secondary stiles with fittings 17. Next the bottom secondary rail 105 is placed against the bottom of flange 28 and also joined with fittings 17 to the secondary stiles. These secondary rails and stiles are joined to the interior surface of the flanges and the skin with glue or adhesive when installed and from an integral box around the flange. Next the surfaces of the rails and stiles of the frame and the secondary rails and stiles are coated with adhesive, and adhesive is also added to the mating surfaces of flange 28 after which the other skin 2 is added to the assembly. As can be seen in FIGS. 8 and 14 the flange 29 on this skin mates with flange 28 of skin 1 to form a secondary frame 300 for the glass insert. Since all the surfaces are coated with glue this skin closes the interior of the door and adheres to the pre-assembled parts. Joinder of the flanges form the secondary frame 300 for the glass insert.

Once this assembly is complete the voids or cavities between the skins and the stiles, rails, secondary stiles and rails, etc are filled with a plastic foam. Thereafter the glass insert 8 can be added and locked in place with the keeper 301 to complete the door.

What is claimed is:

1. An improved molded door having provisions for a large glass insert comprising at least 50% of said door's exterior surface, comprising:

a quadrilateral frame formed of a top rail, a bottom rail, a right stile and a left stile joined together to form said frame;

two sheets of molded door skins, each skin having a large central opening with an integral inwardly directed flange extending normal to its planer surface and around its respective opening, said flanges having mating elements at their distal ends which when joined form an interlocked secondary frame for receiving a glass insert;

means operable to join said skins to said quadrilateral frame;

means operable to join said flanges of said skins in an interlocked relationship of joined flanges around their respective openings;

a secondary left stile located between said joined flanges and said left stile, said secondary left stile joined to said skins; and as secondary right stile located between said joined flanges and said right stile, said secondary right stile joined to said skins.

2. An improved molded door having a glass insert comprising at least 50% of said door's exterior surface, comprising:

a quadrilateral frame formed of a top rail, a bottom rail, a right stile and a left stile joined together;

two sheets of molded door skins, each skin having a large central opening with a integral inwardly directed flange extending normal to its planer surface and around its respective opening, said flanges having mating elements for joining them together at their distal ends;

means operable to join said skins to said quadrilateral frame;

means operable to join said mating elements of said flanges of said skins in an interlocked relationship around their respective openings forming said interlocked secondary frame composed of joined flanges;

a secondary left stile located between said joined flanges and said left stile, said secondary left stile joined to said skins;

as secondary right stile located between said joined flanges and said right stile, said secondary right stile joined to said skins;

a glass insert received in said interlocked frame, and means operable to retain said glass insert in said interlocked frame.

3. The improved molded door according to claim 1, wherein the secondary left stile and the secondary right stile include a long metal plate joined to their inside faces respectively.

4. The improved molded door according to claim 1 wherein the secondary left stile and the secondary right stile comprise a separate elongated member having a length substantially equal to the left and right stiles of said door.

5. The improved molded door according to claim 4 wherein the secondary stiles include a long metal plate joined to them with screws.

6. The improved molded door according to claim 1 wherein the cross-section of the secondary stiles is rectangular.

7. The improved molded door according to claim 1 the secondary stiles are formed of metal.

8. The improved molded door according to claim 1 wherein the secondary stiles abut against the interior of the secondary frame and are joined with the surfaces thereof.

9. The improved molded door according to claim 8 wherein the secondary stiles are made of metal and include a secondary top rail and a secondary bottom rail joined to the top and bottom ends of said secondary stiles respectively.

10. The improved molded door according to claim 1 the secondary stiles of made of a metal u-shaped channel.

11. The improved molded door according to claim 1, wherein the secondary stiles are made of a metal box tube.

12. The improved molded door according to claim 1, wherein the secondary stiles are selected from the group consisting of metal, wood or PVC extruded elements.

* * * * *